US008416978B2

(12) United States Patent
Fukuda

(10) Patent No.: US 8,416,978 B2
(45) Date of Patent: Apr. 9, 2013

(54) VIBRATION PICKUP MICROPHONE

(75) Inventor: Mikio Fukuda, Tokyo (JP)

(73) Assignee: Temco Japan Co., Ltd. (JP)

( * ) Notice: Subject to any disclaimer, the term of this patent is extended or adjusted under 35 U.S.C. 154(b) by 0 days.

(21) Appl. No.: 12/525,673

(22) PCT Filed: Feb. 28, 2008

(86) PCT No.: PCT/JP2008/000376

§ 371 (c)(1),
(2), (4) Date: Aug. 4, 2009

(87) PCT Pub. No.: WO2008/105180

PCT Pub. Date: Sep. 4, 2008

(65) Prior Publication Data

US 2010/0119086 A1 May 13, 2010

(30) Foreign Application Priority Data

Feb. 28, 2007 (JP) ..... 2007-049401

(51) Int. Cl.
*H04R 9/08* (2006.01)

(52) U.S. Cl. ..... 381/369; 381/351; 381/353

(58) Field of Classification Search ..... 381/353, 381/170, 355, 369; 181/158
See application file for complete search history.

(56) References Cited

U.S. PATENT DOCUMENTS

| | | | | |
|---|---|---|---|---|
| 4,450,930 | A * | 5/1984 | Killion | 181/158 |
| 7,171,012 | B2 * | 1/2007 | Izuchi et al. | 381/174 |
| 7,580,533 | B2 * | 8/2009 | Schwartz | 381/172 |
| 2007/0009132 | A1 * | 1/2007 | Miller et al. | 381/369 |

FOREIGN PATENT DOCUMENTS

| | | |
|---|---|---|
| JP | 63-278490 | 11/1988 |
| JP | 11-275681 | 10/1999 |
| JP | 2001-309473 | 11/2001 |

* cited by examiner

*Primary Examiner* — Davetta W Goins
*Assistant Examiner* — Amir Etesam
(74) *Attorney, Agent, or Firm* — Schmeiser, Olsen & Watts, LLP

(57) ABSTRACT

[Problem to be Solved] To provide a high-sensitive compact vibration pickup microphone, suitably used as a talking microphone in high ambient noise environments or as a speech recognition input microphone, with high microphone sensitivity, resistance to sliding noise, and insensitivity to external noise and vibration.

[Solution] A vibration pickup microphone comprising a housing 1 provided with a first space 5 and a second space 6, an external diaphragm 2 disposed over the first space 5, and a microphone unit 3 that is contained in a rear end portion of the second space having an air gap 8 maintained 6, wherein by disposing the external diaphragm 2 over it, an air chamber 7 formed in the first space 5 and an air gap 8 formed in the second space 6 are communicated via a thin passageway 4, so that vibration of voice picked up by the external diaphragm 2 is transmitted to the microphone unit 3 as sound waves, and then frequency components higher than voice frequencies within frequency components of the sound waves are attenuated in its transmitting path.

11 Claims, 4 Drawing Sheets

VIBRATION PICKUP MICROPHONE

TECHNICAL FIELD

The present invention relates to a vibration pickup microphone, and more particularly, a type of vibration pickup microphone that picks up bone vibration and vocal fold vibration.

BACKGROUND ART

Microphones insensitive to external noise and picking up only a speaker's voice include a bone conduction microphone and a throat microphone. A typical bone conduction microphone for picking up bone vibration is an acceleration pickup microphone which uses a piezoelectric element supported by a supporting portion, as shown in FIG. 8.

This type of microphone is in common use since it is highly sensitive while resistant to external noise, but it has drawbacks that it is sensitive to sliding noise and its frequency response is not flat (a large resonance peak for its element occurs).

Also, a dynamic microphone is known, as shown in FIG. 9. The dynamic microphone has advantages of being resistant to sliding noise and easy to use because the frequency response thereof has no large peak. However, the dynamic microphone has drawbacks that it has low sensitivity and is large structurally. This type of dynamic microphone is mainly used as a throat microphone for picking up vocal fold vibration, having a thicker diaphragm to decrease sensitivity to air-conduction sound.

Further, a type of vibration pickup microphone is known, in which bone vibration or vocal fold vibration picked up by its diaphragm are converted to air vibration in an air chamber at the front of a microphone unit such as an electret microphone and then the air vibration is picked up (see FIG. 10).

This type of microphone has high microphone sensitivity and resistance to sliding noise. This is because the vibration is picked up only by its diaphragm, and any portions other than the diaphragm have extremely low sensitivity to vibration. Accordingly, this type of microphone can be resistant to sliding noise.

In this way, though this type of microphone has advantages of having high microphone sensitivity and resistance to sliding noise, it has also a drawback that its anti-noise characteristic is somewhat degraded when used in high ambient noise environments. That is, when the ambient noise level exceeds 110 dB SPL, this type of microphone is more likely to be affected by noises in bands higher than voice bands due to the characteristic of condenser microphones that its frequency range is wider than that of voice band.

Patent Document 1: Japanese Patent Laid-Open No. 2006-20247

Patent Document 2: Japanese Patent Laid-Open No. 2004-229147

Patent Document 3: Japanese Patent Laid-Open No. 2001-292489

DISCLOSURE OF THE INVENTION

Problems to be Solved by the Invention

The present invention has been made in view of the above drawbacks in conventional microphones intended to pick up only a speaker's voice, and an object of the present invention is to provide a high-sensitive compact vibration pickup microphone, which is suitably used as a talking microphone in high ambient noise environments or as a speech recognition input microphone, with high microphone sensitivity, resistance to sliding noise, and insensitivity to external noise and vibration.

Means for Solving the Problems

The invention according to claim 1 for solving the above problems, characterized by comprising a housing provided with a first space with a hole and a second space to contain a microphone unit, an external diaphragm disposed over the hole of the first space, and the microphone unit that is contained in the second space having an air gap maintained in a rear end portion of the second space, wherein by disposing the external diaphragm over the hole of the first space, an air chamber formed in the first space and an air gap formed in a rear end portion of the second space are communicated via a thin passageway, so that vibration of voice picked up by the external diaphragm is transmitted to the microphone unit as sound waves, and then frequency components higher than voice frequencies within frequency components of the sound waves are attenuated in its passage.

In an embodiment of the present invention, wherein the thin passageway is a pore drilled in the housing such that the air chamber and the air gap are communicated.

In other embodiment, wherein the thin passageway is a tube disposed such that one end of the thin passageway opens into the air chamber, and the other end of the thin passageway opens into the air gap. When the thin passageway is the tube, the tube is, preferably, curved and folded in the air chamber, and thus, for example, the tube is made of a soft material that can be freely curved and folded.

In yet other embodiment, the tube is arranged linearly in the air chamber. Then, it is preferable that a length of a portion of the tube within the air chamber is a half or more of the length of the air chamber.

In still other embodiment, the thin passageway is a groove formed on a top surface of the housing in a spiral manner, and in that case, a sheet is wrapped on the groove having only an end portion of the groove open.

Advantages of the Invention

According to the present invention, since high frequencies are suppressed by viscous friction when an air vibration passes through the thin passageway, a vibration pickup microphone with bone vibration pickup characteristic maintained and with a characteristic that it does not easily pick up air-conduction sound can be provided. The present invention also provides a compact vibration pickup microphone with a good bone vibration pickup characteristic.

BEST MODE FOR CARRYING OUT THE INVENTION

The best mode for carrying out the present invention will be described on the basis of accompanying drawings. FIGS. 1 to 3 are vertical cross-sectional views showing respective different embodiments of a vibration pickup microphone according to the present invention.

The vibration pickup microphone according to the present invention, for example, comprises a housing 1 provided with a first space 5 with its top surface open on a topside of the housing 1 and a second space 6 to contain a microphone unit 3 on an underside of the housing 1, an external diaphragm 2 disposed over an hole of the first space 5, and the microphone unit 3 that is contained in the second space 6 having an air gap 8 maintained in a rear end portion of the second space 6. By disposing the external diaphragm 2 over the hole of the first space 5, an air chamber 7 formed in the first space 5 and an air gap 8 formed in the second space 6 are communicated via a thin passageway 4.

The housing 1 is usually made of a high specific gravity material of such as brass, stainless steel and iron, or of an elastic material such as silicone rubber, and the external diaphragm 2 that abuts against skin such as cheek is disposed over the hole of the first space 5.

If the housing 1 is made of the high specific gravity material, it is preferable that an entire outer surface except the hole portion of the housing 1 is covered with a cover made of an elastic material such as silicone rubber. The housing 1 thus formed of the high specific gravity material may decrease the sensitivity thereof to an acoustic pressure (air vibration). The cover made of an elastic material may provide a structure that is more insensitive to external sound and/or unwanted vibration.

The external diaphragm 2 may be glued or welded to a top end surface of the housing (see FIG. 1). A stepped portion is formed on the end surface, and then the external diaphragm 2 may also be fit into and secured to the stepped portion (see FIGS. 2 and 3). The microphone unit 3 is contained in the second space 6 with the air gap 8 maintained in the rear end portion of the second space 6 of the housing 1.

For maintaining the air gap 8, a stepped portion 10 may be formed in the rear end portion of the second space 6 as shown in FIGS. 1 and 2. With the stepped portion 10 thus formed, the air gap 8 is formed by the stepped portion 10 and the diaphragm 9 only by fitting the microphone unit 3 into the second space 6 and then pressing its diaphragm 9 against the stepped portion 10. A condenser microphone, and particularly an electret condenser microphone, is generally used as the microphone unit 3.

The air chamber 7 and the air gap 8 are communicated through the thin passageway 4, so that an acoustic circuit is formed in a space extending from the external diaphragm 2 to the diaphragm 9 of the microphone unit 3, and thereby serves to attenuate components of frequencies higher than voice frequencies.

The thin passageway 4 requires a certain extent of length to obtain good acoustic characteristics. For example, in an embodiment as shown in FIG. 1, the housing 1 has an elongated form to be able to ensure an enough distance between the air chamber 7 and the air gap 8. In this case, the thin passageway 4 is formed by directly drilling a pore in the housing 1 so that the air chamber 7 and the air gap 8 are communicated. The thin passageway 4 is not limited to be linear as shown in FIG. 1, but may also be curved and folded.

As seen from embodiments shown in FIGS. 2 and 3, if the enough distance between the air chamber 7 and the air gap 8 can not be ensured, the thin passageway 4, which is comprised of a tube 11 made of a soft material, may be configured such that one end of the tube 11 opens into the air gap 8, and the other end thereof opens into the air chamber 7.

However, in this case, it is advantageous to transversely curve and fold or serpentine the length of the tube 11 such that the tube 11 has a length enough to attenuate high frequencies (see FIG. 2).

As seen from embodiments shown in FIG. 3, if the housing 1 is oblong and the air chamber 7 therein may also be large, the tube 11 may be linear. However, since the tube 11 requires an enough length within the air chamber 7, a length of a portion extending within the air chamber 7 usually requires at least half or more of the length of the air chamber 7, though it depends on the length of the air chamber 7.

In embodiments shown in FIGS. 4 and 5, the thin passageway 4 is designed as a groove 12 formed in a spiral manner on the top surface of the housing 1. The groove 12 is formed such that its lower end (terminal end) is communicated with the air gap 8 in the center portion of the housing 1, and only its upper end (beginning end) is communicated with the air chamber 7 in a circumferential portion of the housing 1. For this, the groove 12 is wrapped with a sheet 13.

A ventilation notch 14 is formed in the sheet 13. The sheet 13 is positioned such that this ventilation notch 14 is on the end portion of the groove 12, and the sheet 13 is fixed on the groove 12. In order to facilitate this positioning, positioning notches 15, 15 are symmetrically formed in the sheet 13, and projections 16, 16 are protruded, which engage with the positioning notches 15, 15 at positions corresponding to the positioning notches 15, 15 on the top surface of the housing 1, respectively.

In this case, the positioning notches 15, 15 and the projections 16, 16 engage each other, respectively, so that the ventilation notch 14 can be easily and surely positioned at the beginning end of the groove 12, which allows only the upper end (beginning end) of the groove 12 to be communicated with the air chamber 7. Thus, the groove 12 forms the thin passageway 4 in a spiral manner which communicates with the air chamber 7 and the air gap 8.

In this embodiment, the diaphragm 2 has a reversed bowl-like shape, and mounted on a stepped portion 17 formed on an outer peripheral surface of the housing 1 from above. The microphone unit 3 as shown has a rectangular shape, and the second space 6 is also formed into a rectangular shape corresponding to it. Reference numeral 18 denotes a case for containing the housing 1 having the microphone unit 3 loaded and a part of the diaphragm 2.

In considering the use of the vibration pickup microphone with the above configurations according to the present invention, the external diaphragm 2 is abutted against skin such as cheek. Thus, when a user generates voice, the generated vibration of voice (bone vibration) is picked up by the external diaphragm 2, so that the external diaphragm 2 vibrates.

This vibration of the external diaphragm 2 causes air in the air chamber 7 to vibrate, and then the air vibration reaches the diaphragm 9 of the microphone unit 3 through the thin passageway 4 as sound waves. In such case, no external noise reaches the microphone unit 3 since the microphone unit 3 is fully insulated from outside. The microphone unit 3 has a basic feature that it does not easily pick up mechanical vibration, so that the vibration pickup microphone according to the present invention is highly resistant to vibration and external noise.

As above described, sound waves based on vibration of the external diaphragm 2 proceed from the air chamber 7 through the narrow thin passageway 4 a certain amount of distance, and then reach through the air gap 8 to the microphone unit 3. In this way, since sound waves pass through an acoustic circuit composed of the air chamber 7, the thin passageway 4 and air gap 8, components that are higher than voice frequencies and disturb listening to voice are attenuated, and thereby improving a property of the microphone.

FIGS. 6 and 7 show experimental results of measurements and comparison of frequency responses between a vibration pickup microphone according to the present invention as shown in FIGS. 1 to 5 and a conventional vibration pickup microphone as shown in FIG. 10. FIG. 6 shows a result of a comparison of sensitivities to bone vibration, and FIG. 7 shows a result of a comparison of sensitivities to air-conduction sound.

First, when comparing sensitivities to bone vibration with reference to FIG. 6, it will be understood that the conventional vibration pickup microphone obtained a flat high-sensitivity characteristic to near 700 Hz, and such characteristic, however, gradually decreased from there.

On the other hand, the vibration pickup microphone according to the present invention obtained, at a comparable sensitivity, a flat characteristic to near 2 kHz indicative of a peak of the bone conduction characteristic. Thus, it will be understood that the bone vibration pickup characteristic was considerably improved.

Then, when comparing sensitivities to air-conduction sound with reference to FIG. 7, the conventional vibration pickup microphone showed a nearly flat sensitivity characteristic in any frequency bands, though its sensitivity is lower than that to bone vibration. This shows that the conventional vibration pickup microphone tends to collect air-conduction sound over wide range of frequencies.

On the other hand, the vibration pickup microphone according to the present invention showed characteristic in which sensitivity above 2 kHz or more is highly attenuated. This shows that it had a structure that does not easily pick up unwanted air-conduction sound compared to the conventional vibration pickup microphone, and thus effectiveness of the present invention will be understood.

The most preferable embodiment of the present invention has been described in detail to some extent. However, it is apparent that a wide range of different embodiments can be configured without departing from the spirit and scope of the invention, and thus the present invention is not limited to its specific embodiment except limitation in claims.

DESCRIPTION OF SYMBOLS

Figure 1:
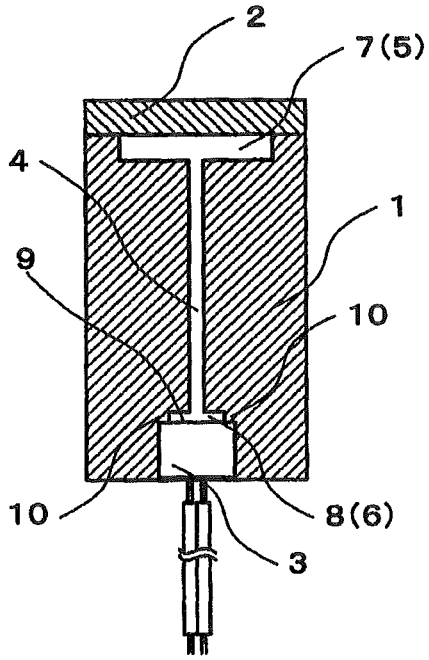
FIG. 1 is a cross-sectional view illustrating an embodiment of a vibration pickup microphone according to the present invention.
Figure 2:
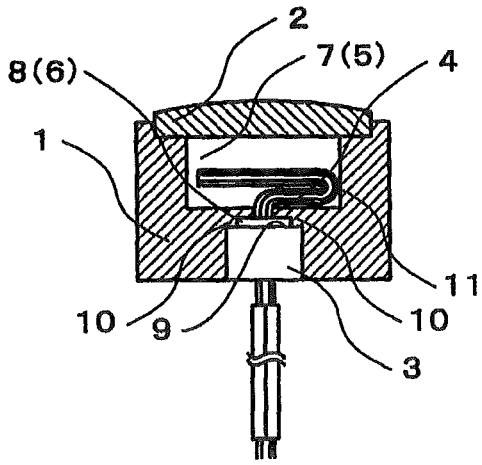
FIG. 2 is a cross-sectional view illustrating another embodiment of a vibration pickup microphone according to the present invention.
Figure 3:
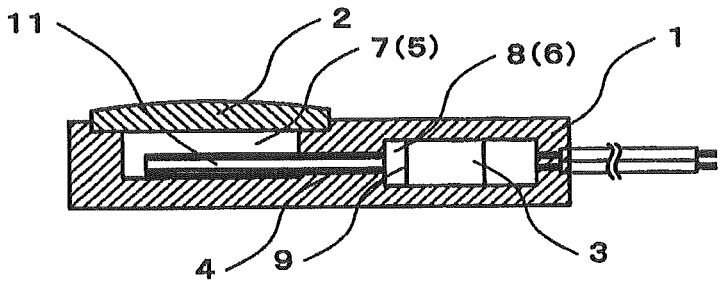
FIG. 3 is a cross-sectional view illustrating yet another embodiment of a vibration pickup microphone according to the present invention.
Figure 4:
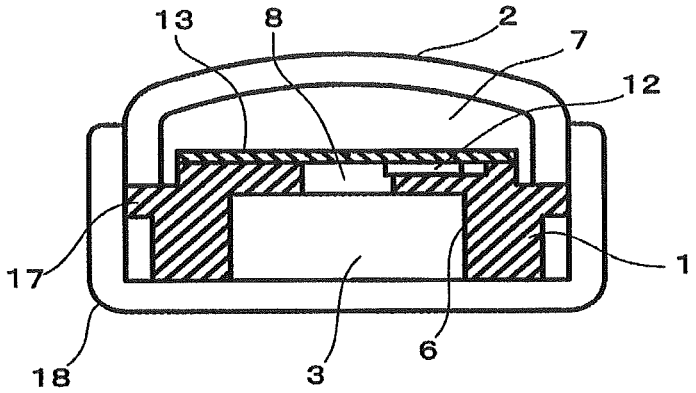
FIG. 4 is a cross-sectional view illustrating still another embodiment of a vibration pickup microphone according to the present invention.
Figure 5:
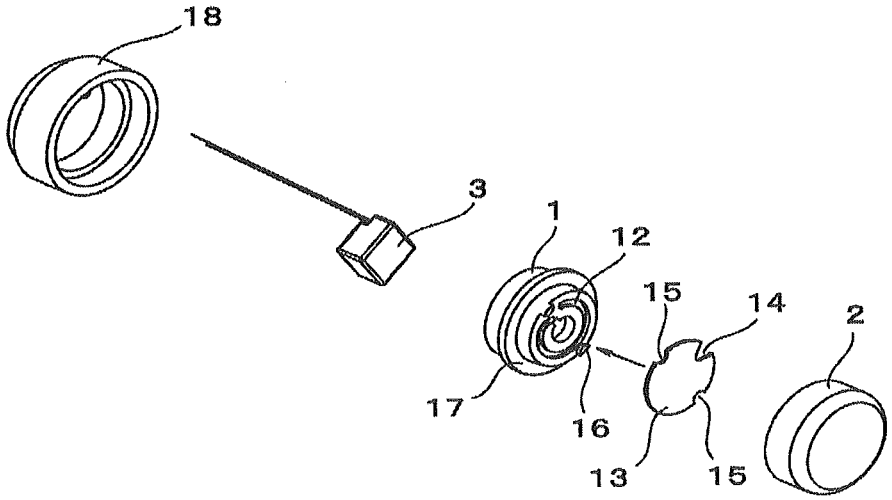
FIG. 5 is an exploded perspective view of a vibration pickup microphone illustrated in FIG. 4.
Figure 6:
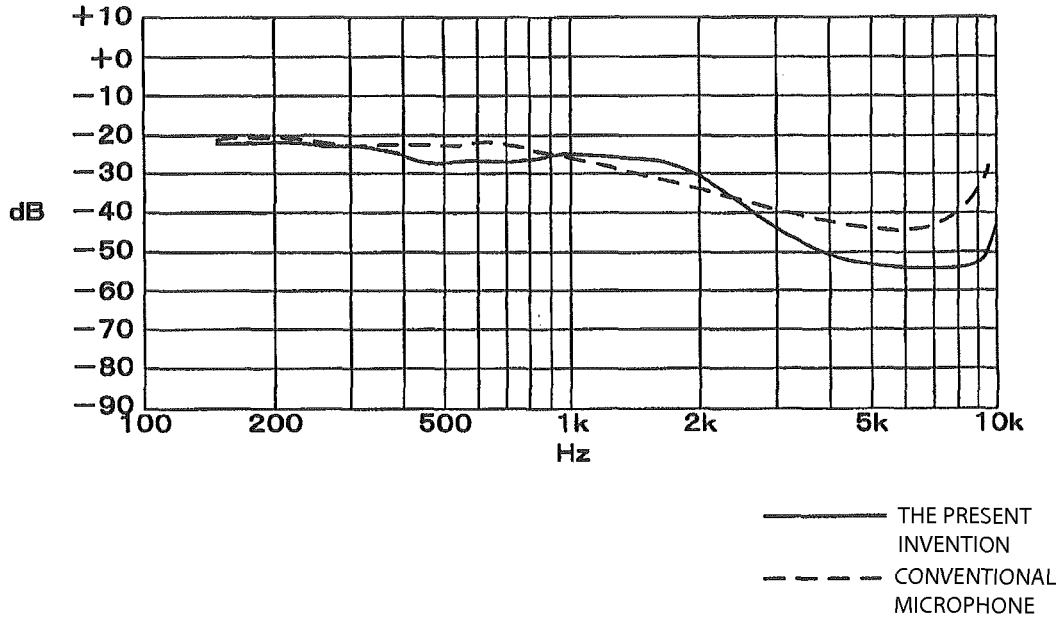
FIG. 6 shows an experimental result of a comparison of frequency responses to bone vibration between a vibration pickup microphone according to the present invention and a conventional vibration pickup microphone.
Figure 7:
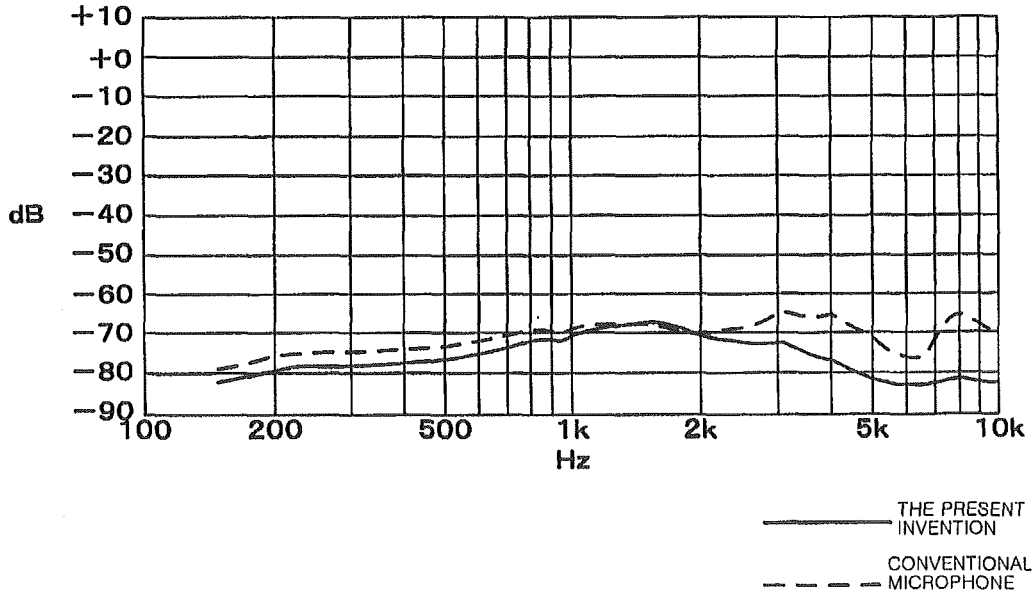
FIG. 7 shows an experimental result of a comparison of frequency responses to air-conduction sound between a vibration pickup microphone according to the present invention and a conventional vibration pickup microphone.
Figure 8:
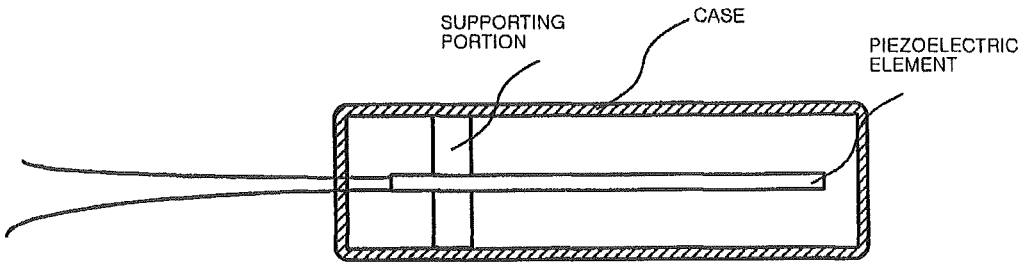
FIG. 8 is a cross-sectional view illustrating a conventional vibration pickup microphone.
Figure 9:
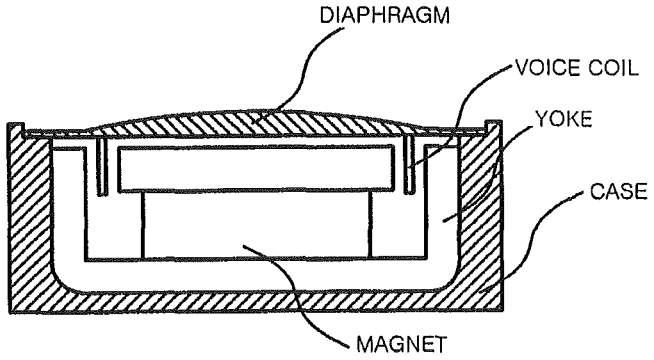
FIG. 9 is a cross-sectional view illustrating another conventional vibration pickup microphone.
Figure 10:
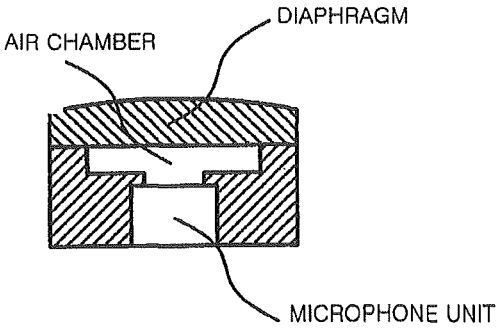
FIG. 10 is a cross-sectional view illustrating yet another conventional vibration pickup microphone.

1. housing
2. external diaphragm
3. microphone unit
4. thin passageway
5. first space
6. second space
7. air chamber
8. air gap
9. external diaphragm
10. stepped portion
11. tube

The invention claimed is:

1. A vibration pickup microphone comprising:

a housing provided with a first space with a hole and a second space to contain a microphone unit, the microphone unit contained in the second space having an air gap maintained by forming a stepped portion in a rear end portion of the second space; and an external diaphragm disposed over the hole of the first space, the external diaphragm configured to abut an external portion of a user's skin;

wherein by disposing the external diaphragm over the hole of the first space, an air chamber formed in the first space and the air gap formed in the rear end portion of the second space are communicated via a thin passageway, the communication via the thin passageway of the air chamber and the air gap forms an acoustic circuit in a space extending from the external diaphragm to a diaphragm of the microphone unit to attenuate components of frequencies higher than voice frequencies;

wherein a vibration of a voice picked up by the external diaphragm is transmitted to the diaphragm of the microphone unit as sound waves, the sound waves passing through the acoustic circuit composed of the air chamber, the thin passageway and air gap allow frequency components that are higher than voice frequencies are attenuated.

2. The vibration pickup microphone according to claim 1, wherein the thin passageway is a pore drilled in the housing such that the air chamber and the air gap are communicated.

3. The vibration pickup microphone according to claim 1, wherein the thin passageway is a tube disposed such that one end of the thin passageway opens into the air chamber, and the other end of the thin passageway opens into the air gap.

4. The vibration pickup microphone according to claim 3, wherein the tube has a curved and folded portion in the air chamber.

5. The vibration pickup microphone according to claim 4, wherein the tube is made of a soft material that can be curved and folded.

6. The vibration pickup microphone according to claim 3, wherein the tube is arranged linearly in the air chamber.

7. The vibration pickup microphone according to claim 6, wherein a length of a portion of the tube within the air chamber is a half or more of the length of the air chamber.

8. The vibration pickup microphone according to claim 1, wherein the thin passageway is a groove formed on a top surface of the housing in a spiral manner.

9. The vibration pickup microphone according to claim 8, wherein a sheet is wrapped on the groove having only an end portion of the groove open.

10. The vibration pickup microphone according to claim 1, wherein the microphone unit is an electret condenser microphone.

11. A vibration pickup microphone comprising:

a housing provided with a first space with a hole and a second space to contain a microphone unit, the microphone unit contained in the second space having an air gap maintained by forming a stepped portion in a rear end portion of the second space; and an external diaphragm disposed over the hole of the first space; the external diaphragm configured to abut a an external portion of a user's skin; wherein by disposing the external diaphragm over the hole of the first space, an air chamber formed in the first space and the air gap formed in the rear end portion of the second space are communicated via a thin passageway, the communication via the thin passageway of the air chamber and the air gap forms an acoustic circuit in a space extending from the external diaphragm to a diaphragm of the microphone unit to attenuate components of frequencies higher than voice frequencies; wherein a vibration of a voice picked up by the external diaphragm is transmitted to the diaphragm of the microphone unit as sound waves, the sound waves passing through the acoustic circuit composed of the air chamber, the thin passageway and air gap allow frequency components that are higher than voice frequencies are attenuated.

* * * * *